US005396674A

United States Patent [19]

Bolds

[11] Patent Number: 5,396,674

[45] Date of Patent: Mar. 14, 1995

[54] INCLINED BODY SUPPORT

[76] Inventor: Nadja M. Bolds, 12503 Sturdee Dr., Upper Marlboro, Md. 20772

[21] Appl. No.: 228,864

[22] Filed: Apr. 18, 1994

[51] Int. Cl.[6] ..... A47C 20/02

[52] U.S. Cl. ..... 5/633; 5/643; 5/630; 5/652; 5/414

[58] Field of Search ..... 5/630, 632, 633, 638, 5/643, 648, 652, 414

[56] References Cited

U.S. PATENT DOCUMENTS

| | | | |
|---|---|---|---|
| 1,640,743 | 8/1927 | Yuhasz . | |
| 2,509,537 | 5/1950 | Stier | 5/633 X |
| 2,663,880 | 12/1953 | Meeks . | |
| 2,666,216 | 1/1954 | Schnaitter . | |
| 3,938,205 | 2/1976 | Spann . | |
| 3,949,435 | 4/1976 | Dionne | 5/630 |
| 3,981,031 | 9/1976 | Schacht . | |
| 5,214,816 | 6/1993 | Collins | 5/633 X |
| 5,269,323 | 12/1993 | Krouskop . | |

FOREIGN PATENT DOCUMENTS

| | | | |
|---|---|---|---|
| 139019 | 5/1948 | Australia | 5/643 |
| 1377482 | 9/1964 | France . | |
| 276981 | 8/1951 | Switzerland | 5/643 |

*Primary Examiner*—Michael F. Trettel
*Attorney, Agent, or Firm*—Stephen R. Greiner

[57] ABSTRACT

An inclined body support includes a frame having a pair of triangular end braces joined-together by stays extending between corresponding corners of the end braces. A releasable coupling arrangement permits the frame to be varied slightly in size and disassembled for storage. A transverse connector joining the lowermost pair of stays near their respective midpoints reinforces the frame. Each of the stays further includes a pair of arms joined by a hinge for relative movement thus permitting the frame to conform to nonplanar supporting surfaces. A padded tent is suspended from the stays for retaining the upper body of a user at an inclination. For additional user comfort, the frame is covered with close-fitting foam pads.

10 Claims, 4 Drawing Sheets

FIG. 5
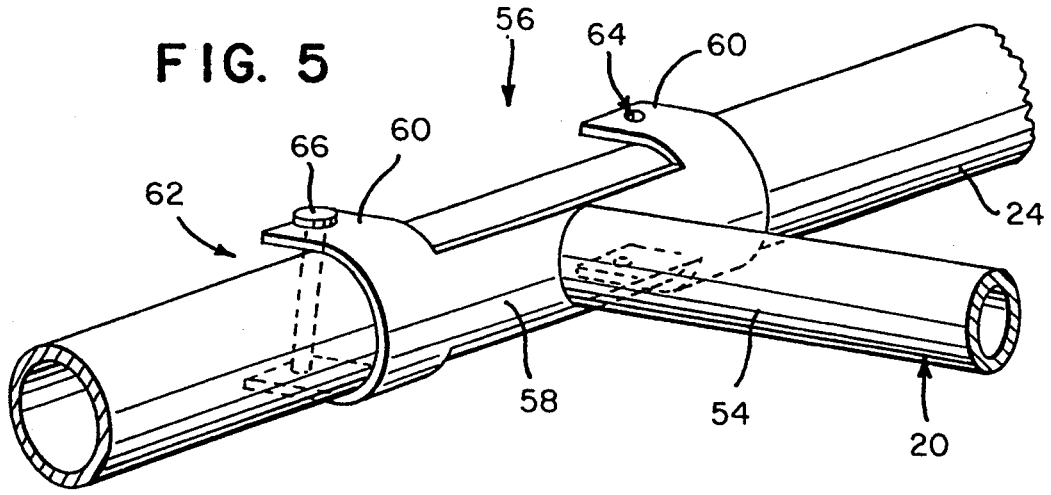
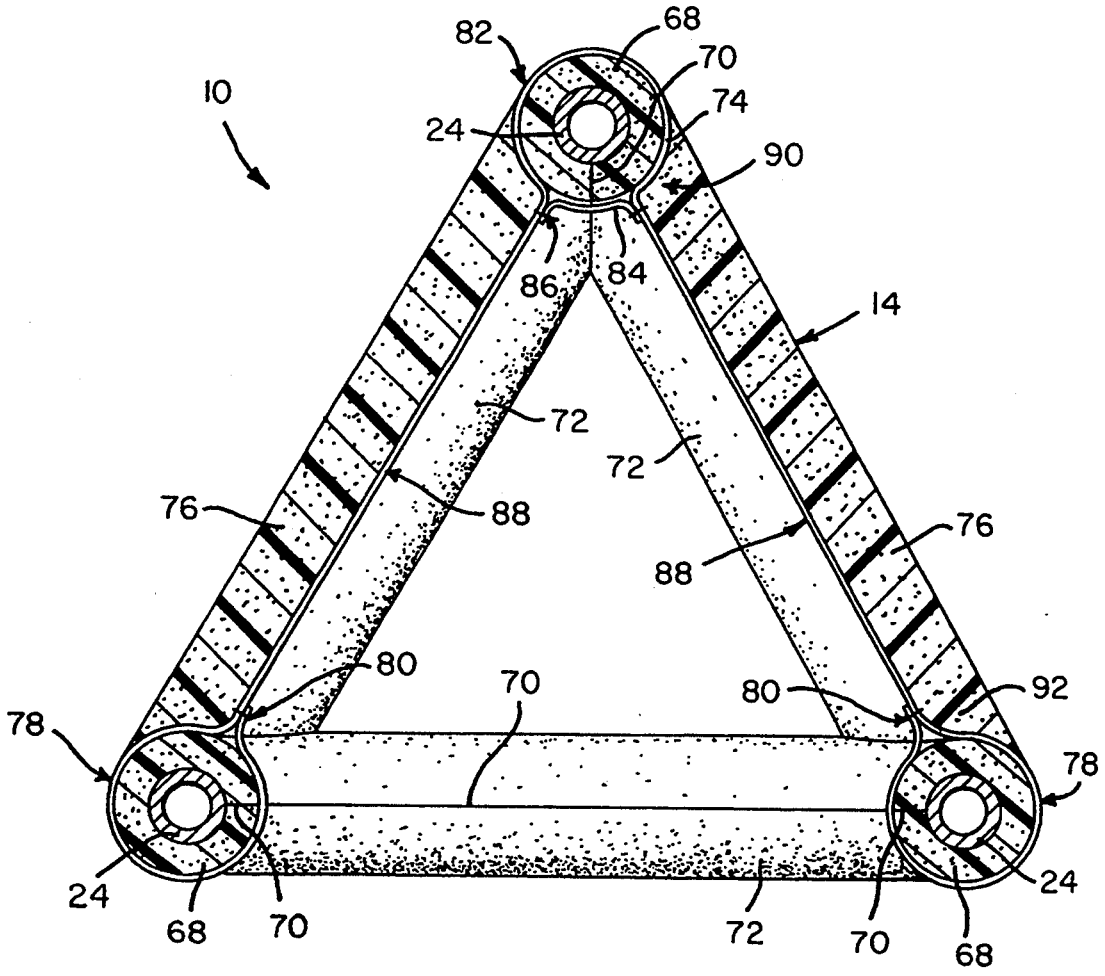
FIG. 6

INCLINED BODY SUPPORT

FIELD OF THE INVENTION

The present invention relates generally to invalid beds or surgical supports, and, more particularly, to a device offering support for the back portions of a user while reclining in bed.

BACKGROUND OF THE INVENTION

Unfortunately, many individuals have become so disabled by the ravages of disease or injury that they are unable to move without assistance. Even turning over in bed can become an impossibility in the absence of a minimum level of muscular strength or control. Thus, for some, the aid and support of one or more attendants is often required for even the slightest changes in body position.

In addition to the frustration caused to the disabled individual, maintaining the same position in bed for extended periods of time can result in a diminished physical health state. Decubitus ulcers, more commonly known a bedsores, often appear, and the bedridden individual can rapidly deteriorate due to the onset of these sores.

Decubitus ulcers are open sores that develop on the skin of individuals who are bedridden, unconscious, or immobile for lengthy periods. They often affect victims of stroke or spinal cord injuries that result in a loss of sensation to the limbs or trunk of the body. AIDS victims in the advanced stages of the illness are also frequently affected. Common attack sites include pressure points such as: shoulders, elbows, lower back, hips, buttocks, knees, ankles, and heels. Dampness or wetness caused by incontinence is also a significant contributing factor in the development of the condition.

Decubitus ulcers often begin as painful, red areas on the skin that darken to an angry purple tone before the skin erupts into an open wound. After the skin has broken, the afflicted area often becomes infected, enlarged, and deepened. An open bedsore is slow to heal and, once developed, will recover only if the pressure on it is minimized. Therefore, adequate care of an immobile person is crucial.

It is generally acknowledged that an invalid's position should be changed at least every two hours to prevent the onset of decubitus ulcers. Once the ulcers have formed, however, it is important to maximize air circulation to the affected areas and to keep same clean, especially if incontinence is a problem. Cushions and pillows are often used to relieve some pressure by placing them between the knees and under the shoulders of an invalid, while sheepskin can be placed under the buttocks and around the heels. Deep, chronic ulcers may also require treatment with antibiotics and possibly surgery.

SUMMARY OF THE INVENTION

In view of the above-mentioned problems, it is a principal object of the present invention to provide a body support that prevents decubitus ulcers from forming on the buttocks, lower back, etc., and aids in the healing of preexisting sores. A wide opening in the present invention receives the inclined buttocks of an invalid user and reduces the periods of contact between ulcer-prone body areas and a supporting surface such as a mattress. Air and blood circulation to the affected region are thereby increased. Personal hygiene is also improved as attendants are now provided with relatively effortless access to the ulcer-prone areas of a user's body for cleansing purposes.

By reducing the development of decubitus ulcers, the pain and discomfort that often accompanies periods of confinement to bed are diminished. Since pain reduction in an individual is generally believed to promote the healing of preexisting injuries, the amount of medication required for the care of a bedridden individual is often reduced. As a result, the overall condition of an bedridden individual improves rapidly when using the present invention.

It is another object of the invention to provide an inclined body support with a resilient frame having a pair of triangular end braces joined together by stays extending between corresponding corners of the braces and a padded tent suspended from the frame for supporting the body of a user at an inclined orientation.

It is a further object of the invention to provide an inclined body support with a resilient frame of metal, or plastic, tubing covered with close-fitting foam pads for user comfort.

It is a further object of the instant invention to provide an inclined body support of the type described wherein its tubular frame components may be adjustably and releasably coupled to conform to the dimensions of a bedridden individual when used and to permit easy storage when not needed.

It is an additional object of the present invention to provide an inclined body support of the type described wherein each of the brace-connecting stays includes a hinge for permitting the frame to conform to nonplanar supporting surfaces such as inclined invalid beds.

An additional object of the present invention is to provide an inclined body support having a body supporting tent including a rectangular fabric sheet with a number of tubular sleeves adapted to slip onto a supporting framework structure for ready removal in the event that cleaning is desired.

A further object of the instant invention is to provide an inclined body support with body supporting tent which includes foam padding material secured to the top of the fabric sheet for added comfort to the user.

It is an object of the invention to provide improved elements and arrangements thereof in an inclined body support for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which:

FIG. 5 is a perspective view showing details of the stay keeper.

FIG. 6 is a cross-sectional view along line 6—6 of FIG. 1.

Similar reference characters denote corresponding features consistently throughout the accompanying drawings.

DETAILED DESCRIPTION OF THE PREFERRED EMBODIMENT

Figure 1:
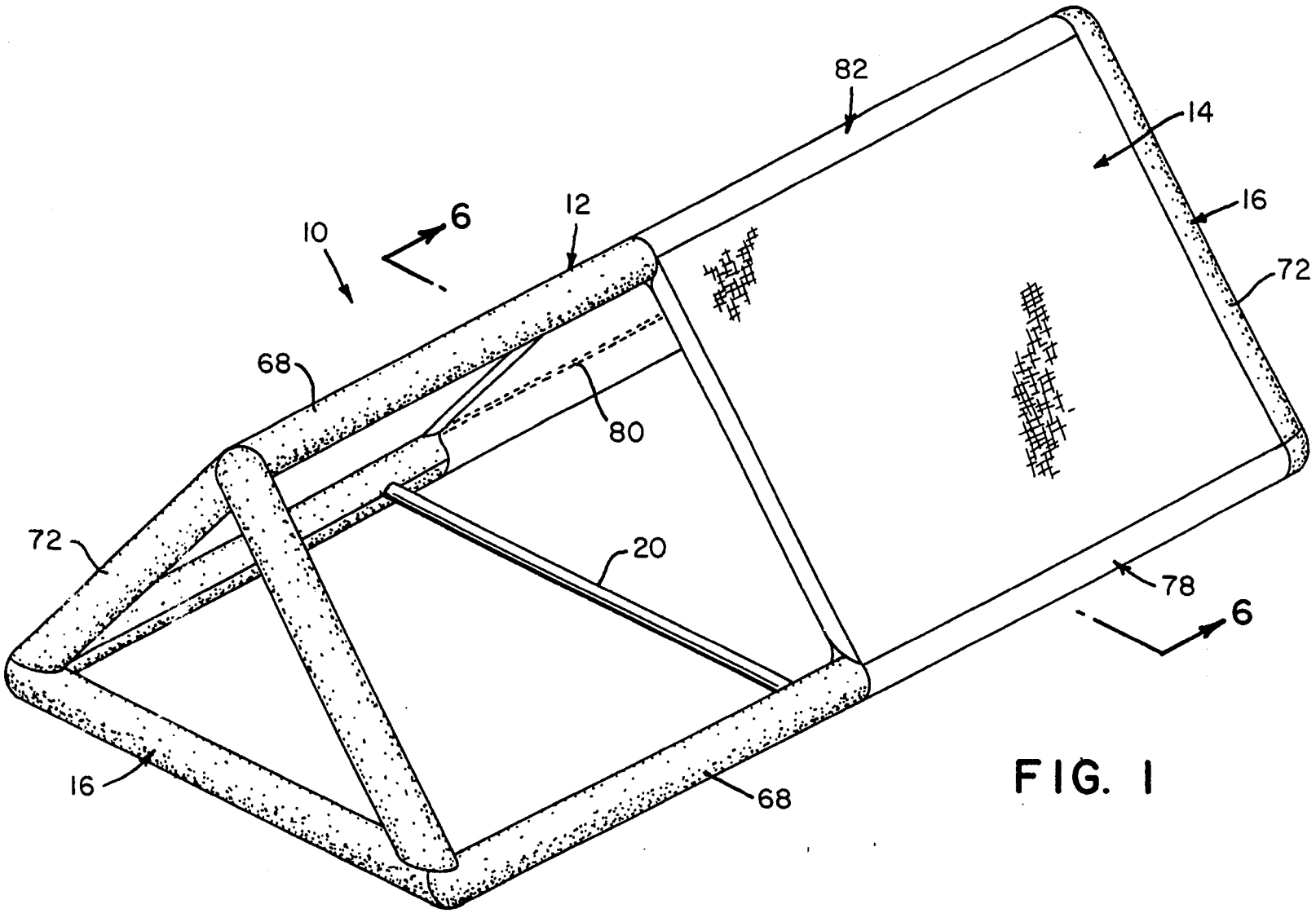
FIG. 1 is a perspective view of an inclined body support in accordance with the present invention.
Figure 2:
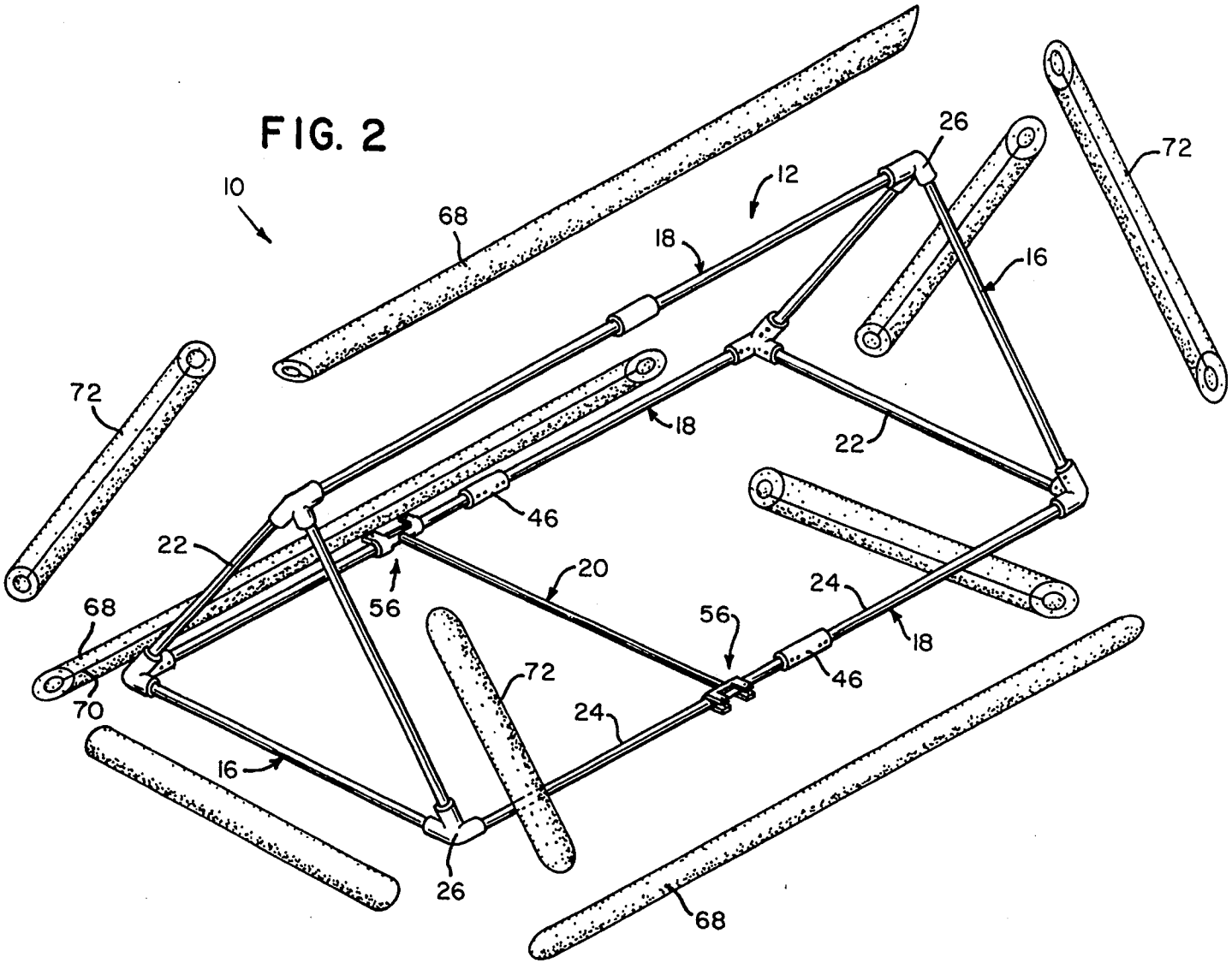
FIG. 2 is an exploded view of the inclined body support of FIG. 1.

Referring now to FIGS. 1 and 2, an inclined body support 10 in accordance with the present invention is illustrated. The support 10 is provided with a padded frame, indicated generally at 12 to which is secured a body supporting tent 14 for retaining the back of a user at an inclined orientation. The frame 12 includes a pair of triangularly-shaped end braces 16 joined to one another at corresponding corners by three hinged stays 18. Additional reinforcement for the frame 12 is offered by a transverse connector 20 which joins the two lowermost stays 18 together near their respective midpoints.

The frame 12 is dimensioned to rest upon the top surface of a mattress or bed and comfortably support the back of a reclining user. Preferably, the horizontal stays 18 position the end braces 16 at a distance from one another from one another so that the user's body, from shoulders to mid-thighs, may be engaged. The upwardly extending sides of the end braces 16, on the other hand, have a length somewhat greater than the width of a user's back for even weight distribution.

The frame 12 is constructed principally from small diameter aluminum tubing which offers some resiliency under load, permitting such to flex slightly and partially conform to the contours of the user's body. In this regard, each end brace 16 includes three lengths of aluminum tubing, hereinafter referred to as legs 22, arranged to meet two by two in three points to form the three angles of a triangle. Preferably, the legs 22 are of equal length, for the sake of interchangeability, and connected together at their respective ends to form an equilateral triangle. Each of the stays 18 include two lengths of aluminum tubing, hereinafter referred to as arms 24, hingedly joined together. Although welds and other fastening means may be used to permanently connect the arms 24 and legs 22 together, it is preferred that releasable couplings be employed so as to permit the frame 12 to be readily taken apart for storage, etc.

Figure 3:
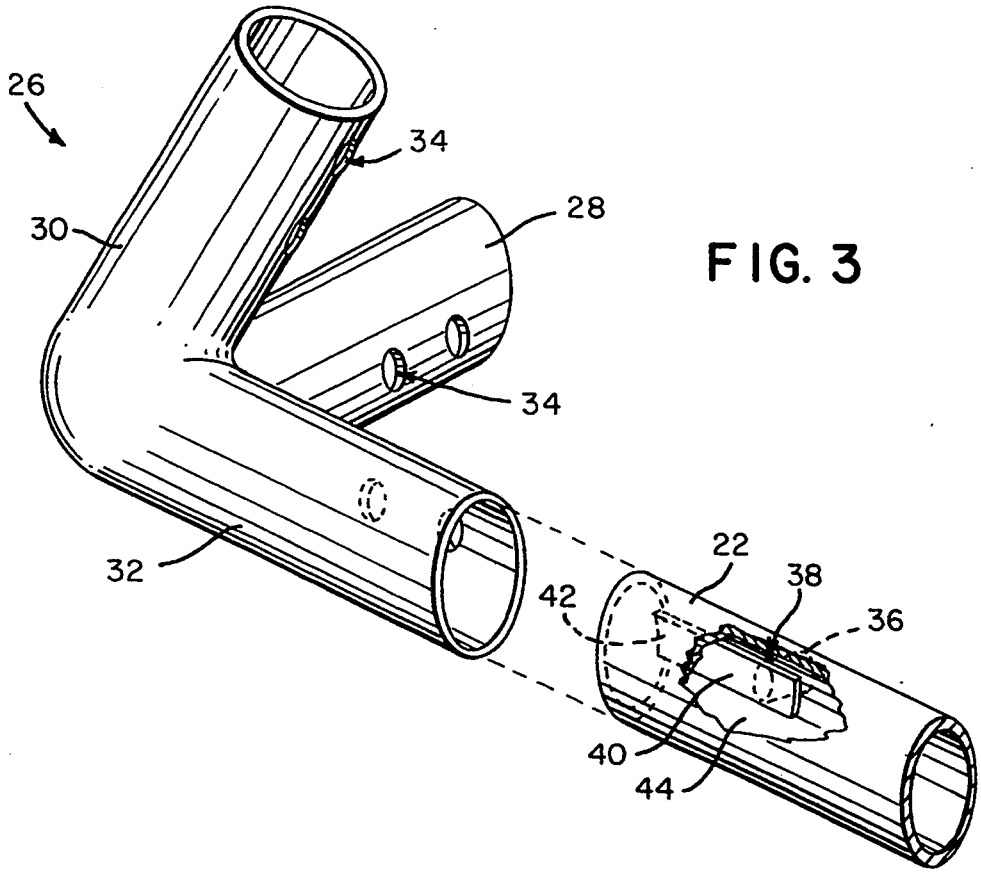
FIG. 3 is a perspective view showing corner bracket connection details.

FIG. 3 shows the preferred releasable coupling arrangement for the frame components. As may be seen, a corner bracket 26, having three outwardly opening sockets 28, 30, and 32 defining three principal openings, is provided to snugly receive the respective ends of one stay arm 24 and two brace legs 22. The bracket walls defining each of the sockets 28, 30, and 32 have individual groupings of smaller, linearly-arranged holes 34 remote from the principal openings for the receipt of a spring-biased pin 36 extending from the side of each arm 24 and leg 22. The pin 36, in well known fashion, may be selectively engaged with any of the holes 34 of a corresponding linear grouping to rigidly secure the stay 18 or leg 22 in place and allow the frame dimensions to be varied slightly to suit the needs of a particular user.

The brackets 26 may be inexpensively molded, or otherwise formed, from a thermoplastic material or metal such as aluminum. Preferably, the longitudinal axes of the sockets 28, 30, and 32 are formed with separate longitudinal axes radiating, respectively, outward from a single point. The longitudinal axes of sockets 28 and 32 are positioned to lie within a first plane and normal to one another. The longitudinal axes of sockets 30 and 32, however, define a second plane perpendicular to the first and diverge from a common point at an angle of 60 degrees. The pin-receiving holes 34 are positioned in the bracket side walls so that their respective centers fall along a line parallel to their corresponding socket axis. Because of this unique structural configuration, the brackets 26 may be interchangeably used at any of the six corners of frame 12 without modifying the shape of the frame.

The opposite ends of each arm 24 and leg 22 include a spring-biased pin 36 projecting outwardly from a close-fitting hole 38 in the sides of the arm or leg. The pin 36 may be joined by any suitable means to the free end of a rectangular, spring metal strip 40. The strip 40, however, is preferably secured within the interior of the arm 24 or leg 22 by welding its unburdened end 42 to the inner wall 44 of the arm or leg. A light pressure applied to the top of the pin 36 causes such to temporarily retract into the hole 38 thereby permitting insertion of an arm 24 or leg 22 into one of the close-fitting bracket sockets 28, 30, or 32. Once engaged, positive locking of the arm 24 or leg 22 to a bracket 26 is maintained by the spring metal strip 40 which biases the pin 36 outwardly into one of the bracket holes 34.

Figure 4:
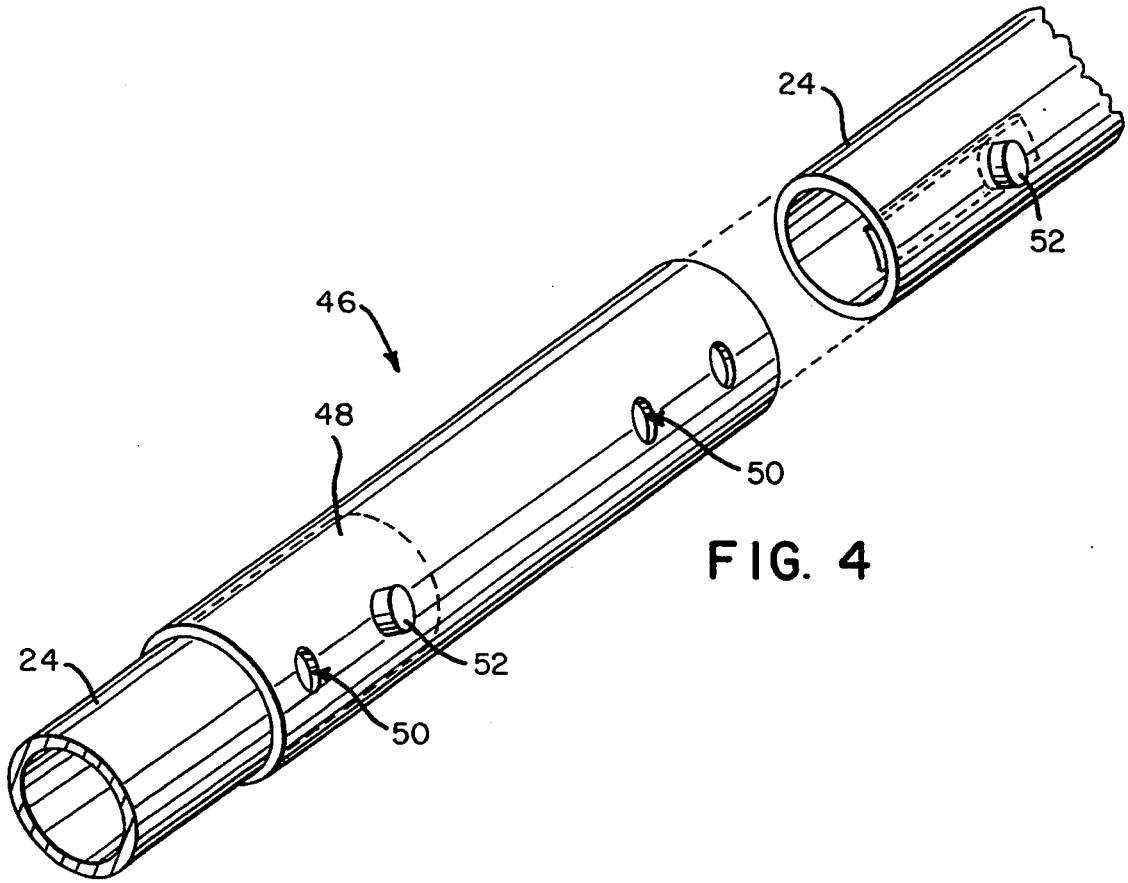
FIG. 4 is a perspective view showing hinge connection details.

Near their respective midpoints, each of the stays 18 is provided with a hinge 46 which permits the frame 12 to conform to the angled surface of a partially-elevated invalid bed. As shown in FIG. 4, the hinge 46 comprises a short segment of flexible rubber tubing 48 having an inner diameter sized to closely engage the exterior surface of the arms 24. The opposing ends of the tubing segments 48 each include a series of holes 50 closely spaced along a line parallel to the longitudinal axis of the tubing segment 48. The holes 50 are sized to receive the spring-biased pins 52 projecting from two arms 24 whose respective ends are inserted into opposite ends of the tubing segment 48. The pins 52 extending from each arm 24 may be selectively engaged with any of the corresponding holes 50 to secure the arm 24 in place and allow the frame length to be varied as desired. Thus, a user reclining on an angled surface, such as an invalid bed, may be comfortably accommodated by the instant invention.

A transverse connector 20 joins the two lowermost stays 18 together at a point near their respective hinges 46. The connector 20 includes a tubular shaft 54 having a forked stay keeper 56 at each of its ends. Preferably, the shaft 54 comprises an aluminum tube having a length substantially equivalent to that of legs 22 and spanning the distance between the two lowermost stays 18. The diameter and wall thickness of the shaft 54 is slightly smaller than that of the legs 22 and offers some resiliency under load, permitting the shaft to flex slightly and conform somewhat to a user's body dimensions. The stay keepers 56 include relatively short transverse bars 58 normally joined at their respective midpoints to the opposing ends of the shaft 58 so as to construct a planar, H-shaped form. Extending from each of the opposing ends of the transverse bars 58 and away from the shaft 54 are a pair of tines 60, each tine a mirror image of the other and together arranged in the form of a "U". The paired tines 60, positioned in a plane normal to that encompassing the shaft 54 and the bars 58, define an outwardly opening slot 62 which generally tapers in width from its opening or entrance to its closed rear. The entrance to the slot 62 is of a width sufficient to enable an arm 24 to be snugly received therein. The depth of the slot 62, on the other hand, is slightly greater than the width or outer diameter of the arms 24 thus permitting the free ends of the tines 60 to "overhang" an arm 24 somewhat when such is received within the slot. As the free end of each tine 60 is provided with a small bore 64, an appropriately sized pin 66 may be inserted therein so as to close the entrance to the slot 62 and positively secure the stay 18 and connector 20 in position relative to one another. Although one connector 20 is shown in the preferred embodiment of the invention, their number may be increased for added strength.

The frame 12 is jacketed with foam padding for user comfort. As may be seen most clearly in FIGS. 2 and 6, each of the longitudinal stays 18 is covered with a tubular, close-fitting, foam pad 68 of sufficient size and density to minimize decubitus ulcer formation opportunities and promote healing of ulcers already formed. The inner diameter of the pad 68 is adequate to securely fit about each of the arms 24 and their connecting tubular hinges 46. The outer diameter of the pad 68, however, is sufficiently great to prevent contact of the user's body with the arms 24 when the foam is compressed during periods of normal use. A longitudinal cut 70 connecting the inner and outer walls of the foam pad 68 permits the pad to be opened slightly and laterally slipped into place upon a corresponding stay 18. The cut 70 also accommodates the keepers 56 of the transverse connector 20, providing an opening through which they may advance. Similarly, the legs 22 of the triangular braces 16 are each covered with foam pads 72 similar in every respect to the pads 68, albeit shorter in length. To further eliminate the possibility of injury, the ends of all the pads 68 and 72 may be suitably cut or beveled so that none of the corner brackets 26 are exposed at the junctures formed between the pads.

A body supporting tent 14, suspended from the frame 12 and partially covering the padded stays 18, supports the back of a user at an inclined orientation. Broadly, the tent 14 comprises a fabric sheet 74, having a width slightly less than that of one of the arms 24, suspended from the stays 18 in the form of an inverted "V". A layer of padding material 76 is joined to the top surface of the sheet 74. When examined closely, the fabric sheet 74 is seen to be rectangular in outline and includes laterally-spaced tubular pockets or sleeves at each of its ends, and at its midpoint, for joining the sheet to the stays 18. The padding material 76 fills the slight depressions in the top of the sheet 74 so that an uninterrupted, planar surface may be presented on each side of the frame 12 for supporting a user.

As is revealed in FIG. 6, each of the outermost sleeves 78 is formed by folding one end of the sheet 74 back upon itself and affixing the now adjoining fabric layers together with a linear, sewn seam 80. The centrally positioned sleeve 82, however, is formed by sewing the opposing sides of a rectangular, fabric segment 84 to the sheet 74 along a pair of seams 86 positioned parallel to the seams 80. Although the fabric segment 84 has a length equivalent to that of the sheet 74, its width is preferably only ¼ of the circumference of the engaged foam pad 68. A fold or gather in the sheet 74 supplies the remaining material required to encircle the pad 68. Both of the sleeves 78 and 82 have inner diameters just large enough for a stay 18, covered by a pad 68, to be closely received therein. When formed in this manner, and slipped upon the padded frame 12, the sheet 74 is provided with a pair of laterally opposed side panels 88 each disposed on a plane which connects the longitudinal axes of the upper and lower stays 18.

Positioned atop each of the side panels 88 is a sheet of foam padding material 76. The foam material 76 is generally rectangular in outline and is of an even thickness throughout. Preferably, the thickness of the material is ½ of the diameter of the pads 68 so as to present a smooth surface to the user on each side of the support 10. The upper and lower ends of the material 76, indicated respectively at 90 and 92, may also be tapered in thickness as shown to accommodate the curved outer surface of the pads 68. Preferably, the foam material 76 is secured to the underlying fabric with well-known adhesive cements which provide a relatively permanent and inexpensive bond. Nevertheless, hook and loop fasteners, snaps, zippers, and buttons, among other fastening means, could be used in the alternative to retain the foam material 76 in place on an impermanent basis.

The inventive support 10 would most commonly be employed by a bedridden individual to prevent the onset of decubitus ulcers and promote the healing of existing sores by increasing air and blood circulation to affected skin areas. For use, the support 10 is first positioned on the top surface of a bed with the longitudinal axes of the stays 18 parallel to the bed sides. Bed side rails (not shown) prevent the support 10 from sliding laterally and maintain the support in a fixed location upon the bed surface. The bedridden individual is then positioned so that his buttocks are within the frame opening adjacent the tent 14. The back of the individual is concurrently propped at an angle against the tent 14 itself. The brace 16, positioned remotely from the tent 14, supports the user's legs at the same angle as his torso. When turning of the individual is required, the support 10 may be moved to the opposite side of the bed and the individual again placed in the desired position against the opposite side of the support.

When not in use, the instant support 10 may be disassembled to greatly reduce its volume for storage. Disassembly may be accomplished by partially removing the cylindrical foam pads 68 and 72 from the frame 12 to expose each of the supporting corner brackets 26. Only a minimal pull need be applied to the pads 68 and 72 to uncover the brackets 26 as the resiliency of the pad material readily allows the longitudinal cuts 70 to open and reveal the more rigid framework beneath. The spring-biased pins 36 are next depressed and the brackets 26 disengaged from their associated arms 24 and legs 22. The tent 14 is then slipped from the still-padded stays 18, folded like a book hinged at the sleeve 82, and set aside. The pads 68 and 72 are removed from the frame 12 and collected. The pins 66 are next removed from the keepers 56 for separation of the transverse connector 20 from the two lowermost stays 18, and the arms 24, legs 22, and connector 20 are gathered together in a bundle for later use. Of course, it should be apparent that the reassembly of the instant support 10 may be readily accomplished by simply reversing the above outlined steps.

It should also be apparent to one skilled on the art that various materials may be used in the construction of the instant invention. In this regard, plastics, graphite and fiberglass composites may be substituted with equal facility in the construction of the frame 12. All are lightweight and high-strength materials which could readily accommodate the loads imparted from individual users of any size and weight when appropriately selected. Further, the foam material employed in the pads 68 and 72 as well as the tent 14 is preferably polyurethane. Nevertheless, open and closed cell foam materials of any chemical composition may be readily substituted therefor provided that adequate resiliency and support are maintained during use.

The instant invention is well adapted to carrying out objects and attain the ends and advantages mentioned above as well as others inherent therein. While the preferred embodiment of the invention has been given for the purpose of disclosure, numerous changes in the details of construction and arrangement of the parts will readily be apparent to those skilled in the art. Thus, it is to be understood that the present invention is not limited to the sole embodiment described above, but encompasses any and all embodiments within the scope of the following claims.

I claim:

1. An inclined body support, comprising:

a frame having a pair of triangular end braces joined together by a plurality of stays each extending between corresponding corners of said braces;

a tent suspended from said frame and partially covering said frame for supporting the body of a user at an inclined orientation; and, a plurality of foam pads covering said frame for user comfort.

2. The inclined body support according to claim 1 wherein said body supporting tent further includes a rectangular fabric sheet having a plurality of laterally spaced tubular sleeves each adapted to fit over one of said plurality of foam pads.

3. The inclined body support according to claim 2 wherein said body supporting tent further includes padding material secured to the top of said fabric sheet.

4. An inclined body support, comprising:

a frame having a pair of triangular end braces joined together by a plurality of stays each extending between corresponding corners of said braces;

a tent suspended from said frame and partially covering said frame for supporting the body of a user at an inclined orientation; and, a transverse connector joining a pair of said plurality of stays near their respective midpoints for additional reinforcement of said frame.

5. The inclined body support according to claim 4 wherein said transverse connector comprises:

a tubular shaft; and, a stay keeper joined to each of the opposing ends of said shaft, each said stay keeper having at least one pair of tines defining an outwardly opening slot for receiving one of said plurality of stays, the free ends of said tines having cooperating bores for the insertion of a pin thereby closing the entrance to the slot and positively securing said transverse connector and stay together.

6. An inclined body support, comprising:

a frame having a pair of triangular end braces joined together by a plurality of stays each extending between corresponding corners of said braces;

a tent suspended from said frame and partially covering said frame for supporting the body of a user at an inclined orientation; and, each of said plurality of stays further includes a pair of arms joined by a hinge for relative movement of said arms thereby permitting said frame to conform to nonplanar supporting surfaces.

7. An inclined body support, comprising:

a frame having a pair of triangular end braces joined together by a plurality of stays each extending between corresponding corners of said braces;

a tent suspended from said frame and partially covering said frame for supporting the body of a user at an inclined orientation; and, each of said pair of triangular end braces comprises three tubular legs joined at their respective ends in a triangular form by three corner brackets.

8. The inclined body support according to claim 7 wherein each said corner bracket comprises:

a first socket and a second socket, each having, respectively, first and second principal openings for the receipt of one of said three legs;

a third socket having a third principal opening for the receipt of one of said plurality of stays;

said first, second, and third sockets having separate longitudinal axes radiating, respectively, outward from a single point;

the longitudinal axes of said first and third sockets lying within a first plane and normal to one another; and, the longitudinal axes of said second and third sockets lying in a second plane perpendicular to said first plane and diverging at an acute angle.

9. The inclined body support according to claim 8 wherein:

said first socket has at least one hole remote from said first principal opening;

said second socket has at least one hole remote from said second principal opening;

said third socket has at least one hole remote from said third principal opening;

each said leg further includes a spring-biased pin at each of its ends for positive engagement with said at least one hole in said first or second sockets; and each said stay further includes a spring-biased pin at each of its ends for positive engagement with said at least one hole in said third socket.

10. An inclined body support, comprising:

a frame having a pair of triangular end braces joined together by a plurality stays each extending between corresponding corners of said braces;

each of said pair of triangular braces having three legs joined together by three corner brackets adapted to retain said legs in a triangular relationship relative to one another;

each of said plurality of stays having a pair of arms joined by a hinge for relative movement thereby permitting said frame to conform to nonplanar supporting surfaces;

a transverse connector joining together a pair of said plurality of stays near their respective midpoints for additional reinforcement of said frame;

a plurality of close-fitting foam pads covering said frame for user comfort; and, a tent suspended from said frame for supporting the body of a user at an inclined orientation.

* * * * *